US010626343B1

(12) United States Patent
Scott

(10) Patent No.: US 10,626,343 B1
(45) Date of Patent: Apr. 21, 2020

(54) ANIMAL-BASED HYDROCARBON FIREARM LUBRICANT

(71) Applicant: Brandon R. Scott, South Jordan, UT (US)

(72) Inventor: Brandon R. Scott, South Jordan, UT (US)

(73) Assignee: Brave Response Shooting, LLC, Highland, UT (US)

( * ) Notice: Subject to any disclaimer, the term of this patent is extended or adjusted under 35 U.S.C. 154(b) by 0 days.

(21) Appl. No.: 16/195,814

(22) Filed: Nov. 19, 2018

Related U.S. Application Data

(60) Provisional application No. 62/588,142, filed on Nov. 17, 2017.

(51) Int. Cl.

| | |
|---|---|
| ***C10M 111/06*** | (2006.01) |
| ***C10M 109/00*** | (2006.01) |
| ***C10M 101/02*** | (2006.01) |
| ***C11D 3/384*** | (2006.01) |
| ***C11D 3/382*** | (2006.01) |
| ***C11D 11/00*** | (2006.01) |
| ***F41A 29/04*** | (2006.01) |
| ***C11D 3/50*** | (2006.01) |

(52) U.S. Cl.
CPC ..... *C10M 111/06* (2013.01); *C10M 101/02* (2013.01); *C10M 109/00* (2013.01); *C11D 3/382* (2013.01); *C11D 3/384* (2013.01); *C11D 3/50* (2013.01); *C11D 11/0029* (2013.01); *F41A 29/04* (2013.01); *C10M 2203/1006* (2013.01); *C10M 2207/401* (2013.01); *C10N 2220/082* (2013.01)

(58) Field of Classification Search
CPC ..... F41A 29/04; F41A 29/00
USPC ..... 42/90, 95, 96
See application file for complete search history.

(56) References Cited

U.S. PATENT DOCUMENTS 6,105,591 A * 8/2000 DeCare ..... F41C 9/085 134/2
7,632,788 B2 * 12/2009 Jao ..... B82Y 30/00 508/410
9,222,050 B1 * 12/2015 Simonetti ..... C10M 125/26
9,624,973 B2 * 4/2017 Cho ..... F41A 21/00
9,637,705 B1 * 5/2017 Waldron ..... C10M 111/02
9,719,042 B2 * 8/2017 Simonetti ..... C10M 125/26
9,879,197 B2 * 1/2018 Sugg ..... C10M 105/36
10,066,180 B1 * 9/2018 Sugg ..... B08B 3/04
2004/0138073 A1 * 7/2004 Karol ..... C10M 141/12 508/195
2009/0155479 A1 * 6/2009 Xiao ..... C23C 4/06 427/451
2010/0040864 A1 * 2/2010 McGilvray ..... F16C 33/12 428/323
2010/0048436 A1 * 2/2010 Litters ..... C10M 117/02 508/174
2010/0113312 A1 * 5/2010 Ward ..... C10M 125/26 508/158
2010/0187925 A1 * 7/2010 Tingler ..... B82Y 30/00 310/87
2010/0199943 A1 * 8/2010 Carrick ..... C10M 163/00 123/196 R
2012/0214717 A1 * 8/2012 McLaughlin ..... B82Y 30/00 508/165
2012/0302472 A1 * 11/2012 Litters ..... C10M 135/10 508/122
2012/0304545 A1 * 12/2012 Park ..... B82Y 30/00 51/307
2013/0047879 A1 * 2/2013 Lacy ..... F42B 12/40 102/382
2014/0371119 A1 * 12/2014 Mosleh ..... C10M 171/00 508/129
2015/0017346 A1 * 1/2015 Sugg ..... C10M 105/36 427/553
2015/0252284 A1 * 9/2015 Waldron ..... C10M 169/042 42/96
2015/0267990 A1 * 9/2015 Togias ..... F41A 29/04 89/1.11
2016/0075962 A1 * 3/2016 Simonetti ..... C10M 125/26 508/125
2018/0119044 A1 * 5/2018 Sugg ..... C10M 105/36
(Continued)

OTHER PUBLICATIONS

Ryan Lenz; Company Sells Gun Oil Laced With Pig Fat to Deny Muslims Paradise; May 26, 2011; https://www.splcenter.org/hatewatch/2011/05/26/company-sells-gun-oil-laced-pig-fat-deny-muslims-paradise (Year: 2011).*

(Continued)

*Primary Examiner* — Joshua E Freeman

(74) *Attorney, Agent, or Firm* — Durham Jones & Pinegar, P.C., Intellectual Property Law Group

(57) ABSTRACT

A lubricant for firearms includes a base and nanoparticles dispersed throughout the base. The base may include a hydrocarbon or a mixture of hydrocarbons. The base may be in a liquid form or in a semisolid form. Fat from an animal source, such as porcine fat or, more specifically, bacon fat, may be employed as a hydrocarbon of the base. Fat from an animal source may be rendered or otherwise clarified. The nanoparticles may include nanospheres, which may have an average diameter of about 100 nm or less. The lubricant may also include a hydrocarbon from a vegetable source (e.g., a vegetable oil, etc.), a hydrocarbon from a petrochemical source, and/or a synthetic petrochemical lubricant. The lubricant may include a fragrance to impart it with a desired scent (e.g., a bacon scent, etc.). Methods for lubricating and cleaning metallic surfaces of firearms are also disclosed. In such a method, nanoparticles from a lubricant may be introduced into and retained within microscopic crevices in the metallic surfaces.

14 Claims, No Drawings

(56) References Cited

U.S. PATENT DOCUMENTS

2019/0225910 A1* 7/2019 Waldron ..... C10M 169/04

OTHER PUBLICATIONS

Liberal Tears Gun Lube; https://web.archive.org/web/20160209022856/http:/liberaltears.net/; Feb. 9, 2016 (Year: 2016).*

* cited by examiner

ANIMAL-BASED HYDROCARBON FIREARM LUBRICANT

CROSS-REFERENCE TO RELATED APPLICATION

A claim for the benefit of priority to the Nov. 17, 2017 filing date of U.S. Provisional Patent Application No. 62/588,142, titled "ANIMAL-BASED HYDROCARBON FIREARM LUBRICANT ("the '142 Provisional Application") is hereby made pursuant to 35 U.S.C. § 119(e). The entire disclosure of the '142 Provisional Application is hereby incorporated herein.

TECHNICAL FIELD

This disclosure relates generally to lubricants for firearms. More specifically, this disclosure relates to lubricants that include animal-based hydrocarbons through which nanoparticles are dispersed and, more specifically, to lubricants that include porcine hydrocarbons and nanoparticles. In addition, this disclosure relates to methods for lubricating and cleaning firearms, in which a lubricant that comprises a porcine hydrocarbon and nanoparticles is applied to a surface of a metal feature of the firearm.

SUMMARY

In one aspect, compositions that may be used for a variety of purposes, including, without limitation, as lubricants for firearms, are disclosed. For the sake of simplicity, compositions according to this disclosure are referred to as "lubricants." Some common names for lubricants for firearms are "gun oil," "gun lube," and "gun grease." As used herein, the term "lubricant" encompasses a variety of different forms (e.g., viscosities, etc.) of lubricants. A lubricant according to this disclosure include a base and nanoparticles dispersed throughout the base.

The base of a lubricant of this disclosure may comprise a hydrocarbon (e.g., fat, oil, etc.) or a mixture of hydrocarbons. The hydrocarbon may be obtained from an animal source. In a specific embodiment, the hydrocarbon may be obtained from a porcine (i.e., pig) source, although a variety of other animals may also serve as suitable sources for the hydrocarbon of a lubricant according to this disclosure. In embodiments where the hydrocarbon is obtained from an animal source, the hydrocarbon may comprise fat, which may be in a liquefied form or in a semisolid form. The fat may comprise rendered fat (e.g., lard, oil, etc.), from which at least some sugars, salts, and other components have been removed from the fat.

In addition or as an alternative to including a hydrocarbon from an animal source, a lubricant according to this disclosure may include a hydrocarbon obtained from a plant source. Such a hydrocarbon may comprise an oil obtained from a plant source (e.g., a vegetable oil, such as canola oil, etc.).

In some embodiments, the hydrocarbon or a portion of the hydrocarbon of a lubricant according to this disclosure may comprise any other hydrocarbon that may be suitable as a lubricant and/or as a cleaning agent. As an example, the hydrocarbon may comprise a petrochemical lubricant or a synthetic petrochemical lubricant (e.g., an engine lubricant, such as engine oil, transmission oil, etc.).

The nanoparticles of a lubricant according to this disclosure may be dispersed throughout the base of the lubricant, or throughout at least a portion of the base of the lubricant.

Shapes of the nanoparticles may enable them to roll or slide past one another in a manner that reduces friction as an object contacts and moves across a surface to which the lubricant has been applied. A few examples of such shapes include spheres (i.e., nanospheres, including solid nanospheres and hollow nanospheres), ellipsoids, and tori (the plural form of torus). Sizes of the nanoparticles may enable them to fill microscopic crevices or other microscopic recesses that are present in the surfaces to which the lubricant may be applied (e.g., a surface of a metallic feature of a firearm, etc.). As an example, the microparticles may have an average particle size of about 100 nm or less.

The materials from which the nanoparticles are formed may withstand (i.e., not degrade when subjected to) repeated friction, include the heat and pressure associated with such friction. In embodiments where the lubricant is capable of use as a lubricant for firearms, or where the lubricant is formulated for use in lubricating firearms, the materials from which the nanoparticles may be formed may withstand repeated use of the firearm (e.g., its barrel, recoil spring, slide and rails, etc.) without degradation or substantial degradation. Examples of such materials include, but are not limited to, carbon, boron nitride, and organic materials.

The nanoparticles may also be formed from materials that enable them to adhere to the surface(s) to which they are applied. In embodiments where the nanoparticles are to be applied to surfaces of metal features, the nanoparticles may be capable of magnetically adhering to the surfaces of the metal features.

The lubricant may also include a fragrance to impart the lubricant with a desired scent. The fragrance may comprise a lipophilic substance to enable it to diffuse throughout the hydrophilic material(s) of the base. A bacon scented fragrance may be used in embodiments where the base of the lubricant comprises porcine fat.

In another aspect, this disclosure relates to methods for cleaning and lubricating firearms. In such a method, the firearm may be cleaned in a conventional manner. Such cleaning may enable nanoparticles from a previously used lubricant of this disclosure to remain within microscopic crevices and other microscopic recesses that are present in the lubricated surfaces of the firearm. A lubricant according to this disclosure may then be used to lubricate features are subjected to repeated friction, such as the barrel of the firearm and, in embodiments where the firearm is a semi-automatic firearm or an automatic firearm, to its recoil spring(s) and to its slides and rails. Excess lubricant may then be wiped from the firearm (e.g., with a cleaning element, such as a cloth, a clean patch, a cotton swab, etc.), with nanoparticles remaining in any microscopic crevices or other microscope recesses in each surface to which the lubricant is applied.

Other aspects of the disclosed subject matter, as well as features and advantages of various aspects of the disclosed subject matter, will become apparent to those of ordinary skill in the art though consideration of the ensuing description and the accompanying claims.

DETAILED DESCRIPTION

A specific embodiment of a lubricant according to this disclosure includes a base with nanoparticles dispersed throughout the base. The lubricant may also include other components, such as a fragrance, a colorant, or the like.

The base of a lubricant according to this disclosure may comprise a hydrocarbon obtained from an animal source, such as porcine fat. Such a hydrocarbon may be rendered to remove salts, sugars, and other substances, including contaminants, from the hydrocarbon. Such a hydrocarbon may be included in the lubricant in a liquid form or in a semisolid form. A hydrocarbon from an animal source may comprise about 40% of a volume of a lubricant according to this disclosure to just under 100% of the volume of the lubricant (at least some of the remainder of the volume of such an embodiment would be occupied by the nanoparticles). In a specific embodiment, liquefied, rendered bacon fat may be used as at least a portion of the base of the lubricant, and define at least 50% of a volume of the lubricant (e.g., about 50%, about 55%, about 60%, about 65%, about 70%, about 75%, about 80%, etc., of a volume of the lubricant).

In addition to including a hydrocarbon from an animal source, the base of the lubricant may include a hydrocarbon from a plant source. Such a hydrocarbon may be included in the lubricant in any desired viscosity (e.g., as a liquid, as a semisolid substance, etc.). A plant-based hydrocarbon may make up less than half of the volume of the lubricant (e.g., less than 50%, about 45%, about 40%, about 35%, about 30%, about 25%, about 20%, about 15%, about 10%, about 5%, etc.). Vegetable oils, such as canola oil, may be included as part of the hydrocarbon of the base of a lubricant according to this disclosure.

The base of the lubricant may also include one or more other types of hydrocarbons, including, without limitation, one or more petrochemical lubricants and/or one or more synthetic petrochemical lubricants.

Some of the hydrocarbons of the base may be included part of another component. As an example, the nanoparticles may be carried by a hydrocarbon or by a mixture of hydrocarbons. Any fragrance and/or colorant may also be carried by a hydrocarbon or by a mixture of hydrocarbons. In a specific embodiment, the nanoparticles may be carried by a petrochemical lubricant or by a synthetic petrochemical lubricant.

The nanoparticles may be dispersed throughout the base of the lubricant, or throughout at least a portion of the base of the lubricant. The nanoparticles may have shapes that enable them to roll or slide past one another in a manner that reduces friction as an object contacts and moves across a surface to which the lubricant has been applied. A few examples of such shapes include spheres (i.e., nanospheres, including solid nanospheres and hollow nanospheres), ellipsoids, and tori (the plural form of torus). The nanoparticles may have sizes that enable them to fill microscopic crevices or other microscopic recesses that are present in the surfaces to which the lubricant may be applied (e.g., a surface of a metallic feature of a firearm, etc.). As an example, the microparticles may have an average particle size (e.g., diameter, etc.) of about 100 nm or less. By way of example, the nanospheres of NANO LUBE® Multi-Purpose Lubricant available from Nano Lube Corporation of Naples, Fla., may be used in a lubricant according to this disclosure. According to Nano Lube Corporation, the nanospheres in that product can magnetically adhere to the surfaces of metallic features to which they are applied.

In a more specific embodiment, a lubricant according to this disclosure consists essentially of or consists of porcine fat, oil, and nanospheres. Such a lubricant may include fragrance as an essential component or as a non-essential component. Such a lubricant may include a colorant as a non-essential component.

The porcine fat of the lubricant may be bacon fat. The bacon fat may be rendered bacon fat, and it may be liquefied. The porcine fat may make up about 60% of a volume of the lubricant.

At least a portion of the oil of the lubricant may be an oil from a plant source. Such an oil may be a vegetable oil or a combination of vegetable oils. An example of a vegetable oil that may be included in the lubricant is canola oil. Vegetable oil may make up about 20% of the volume of the lubricant.

A carrier for the nanospheres and/or a carrier for the fragrance may make up a portion of the oil of the lubricant (e.g., NANO-LUBE® Multi-Purpose Lubricant, etc.). The carrier for the nanospheres may be a petrochemical lubricant or a synthetic petrochemical lubricant (e.g., an engine lubricant, such as engine oil, transmission oil, etc.).

The nanospheres may be the nanospheres that are included in NANO-LUBE® Multi-Purpose Lubricant. The NANO-LUBE® Multi-Purpose Lubricant, including the nanospheres and the carrier for the nanospheres, may make up about 10% of the volume of the lubricant.

The fragrance may impart the lubricant with a desired scent. In embodiments where porcine fat is a component of the lubricant, the fragrance may be a bacon scented fragrance. The fragrance may make up about 10% of the volume of the lubricant.

When a lubricant according to this disclosure is used to lubricate a firearm, the firearm may be cleaned, and then the lubricant applied in a conventional manner. The firearm may then be used in a conventional manner, and then re-cleaned and re-lubricated, if desired.

Although the foregoing disclosure provides many specifics, these specifics should not be construed as limiting the scope of any of the claims, but merely as providing illustrations of some embodiments and variations of elements and/or features of the disclosed subject matter. Features from different embodiments may be employed in combination. Other embodiments of the disclosed subject matter may be devised. Accordingly, the scope of each claim is limited only by its plain language and the legal equivalents thereto.

What is claimed is:

1. A lubricant for use with firearms, comprising:

a base comprising bacon fat, vegetable oil, and a carrier for nanospheres, with the bacon fat comprising about 60% of the volume of the lubricant and the vegetable oil comprising about 20% of the volume of the lubricant; and the nanospheres having an average diameter of about 100 nm or less dispersed throughout the bacon fat, the vegetable oil, and the carrier for nanospheres, the nanospheres and the carrier for nanospheres together comprising at least about 10% of the volume of the lubricant.

2. The lubricant of claim 1, wherein the nanospheres are capable of adhering to metallic surfaces of the firearm.

3. A lubricant for use with firearms, consisting of:

porcine fat;

a blend of vegetable oil and a petrochemical lubricant or a synthetic petrochemical lubricant;

nanoparticles dispersed throughout the porcine fat and the blend; and fragrance.

4. The lubricant of claim 3, wherein the fragrance is a bacon scent.

5. The lubricant of claim 3, wherein the nanoparticles are nanospheres.

6. The lubricant of claim 5, wherein the nanospheres have an average diameter of about 100 nm or less.

7. The lubricant of claim 6, wherein the nanospheres are capable of adhering to metallic surfaces of the firearm.

8. The lubricant of claim 3, wherein:

the porcine fat makes up about 60% of a volume of the lubricant; and the vegetable oil makes up about 20% of the volume of the lubricant.

9. The lubricant of claim 8, wherein:

a portion of the blend is provided by a source of the nanoparticles; and the nanoparticles and the portion of the blend make up about 10% of the volume of the lubricant.

10. A method for lubricating a firearm, comprising:

applying a lubricant consisting of porcine fat and a blend of oils with nanoparticles dispersed therethrough and a bacon fragrance to a metal feature of the firearm; and moving at least one of the metal feature and another metal feature against one another to spread the lubricant onto the metal feature and to force the nanoparticles of the lubricant into microscopic recesses in a surface of the metal feature.

11. The method of claim 10, wherein moving at least one of the metal feature and the another metal feature against one another comprise moving adjacent metal features of the firearm against each other.

12. The method of claim 10, further comprising:

discharging the firearm.

13. The method of claim 10, further comprising:

cleaning the metal feature of the firearm, with the nanoparticles in the microscopic recesses in the metal feature remaining in the microscopic recesses after cleaning the metal feature of the firearm.

14. The method of claim 13, wherein cleaning the metal feature of the firearm comprises applying the lubricant to the metal feature and wiping the metal feature with a cleaning element.

* * * * *